US009047722B2

(12) United States Patent
Kurnik et al.

(10) Patent No.: US 9,047,722 B2
(45) Date of Patent: Jun. 2, 2015

(54) VEHICLE LOCATION AND FAULT DIAGNOSTIC SYSTEMS AND METHODS

(71) Applicant: GM Global Technology Operations LLC, Detroit, MI (US)

(72) Inventors: Jeanette C. Kurnik, Linden, MI (US); Daniel P. Grenn, Highland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/045,282

(22) Filed: Oct. 3, 2013

(65) Prior Publication Data

US 2015/0100199 A1 Apr. 9, 2015

(51) Int. Cl.
*G07C 5/08* (2006.01)

(52) U.S. Cl.
CPC ..... *G07C 5/0816* (2013.01); *G07C 5/0808* (2013.01); *G07C 5/085* (2013.01)

(58) Field of Classification Search
CPC ..... G07C 5/816; G07C 5/808; G07C 5/85
USPC ..... 701/32.4, 33.2, 31.4, 22; 5/32.4
See application file for complete search history.

(56) References Cited

U.S. PATENT DOCUMENTS 6,330,499 B1 * 12/2001 Chou et al. ..... 701/31.4
6,754,485 B1 * 6/2004 Obradovich et al. ..... 455/414.1
7,319,848 B2 * 1/2008 Obradovich et al. ..... 455/99
7,778,746 B2 * 8/2010 McLeod et al. ..... 701/22
8,068,951 B2 * 11/2011 Chen et al. ..... 701/31.4

* cited by examiner

*Primary Examiner* — Mary Cheung
*Assistant Examiner* — Michael Berns

(57) ABSTRACT

A fault diagnostic system of a vehicle includes: a global positioning system (GPS) receiver and a diagnostic module. The GPS receiver determines a location of the vehicle. The diagnostic module diagnoses a fault in a component of the vehicle. In response to the diagnosis of the fault, the diagnostic module stores diagnostic data in a computer readable medium. The diagnostic data includes both a predetermined diagnostic trouble code associated with the fault diagnosed and the location of the vehicle when the fault was diagnosed.

8 Claims, 7 Drawing Sheets

VEHICLE LOCATION AND FAULT DIAGNOSTIC SYSTEMS AND METHODS

FIELD

The present disclosure relates to vehicles and, more particularly, to fault diagnostic systems and methods.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Operation of a vehicle may be regulated by one or more control modules. A control module may diagnose faults in various components of a vehicle. A fault may affect engine performance, emissions, braking, and/or other onboard systems of the vehicle. For example, a control module may diagnose faults in driver interface devices (e.g., accelerator pedal), sensors (e.g., manifold temperature sensor), actuators (e.g., throttle valve), and/or other vehicle components.

When a fault is diagnosed, the control module may generate a diagnostic trouble code (DTC) that identifies the specific fault diagnosed. The control module stores the DTC. The DTC can be used to identify the faulty component. For example, a service tool communicates with the control module to retrieve the DTC. The DTC may then be used in conjunction with other service procedures to fully diagnose and repair the faulty component.

SUMMARY

A fault diagnostic system of a vehicle includes: a global positioning system (GPS) receiver and a diagnostic module. The global positioning system determines a location of the vehicle. The diagnostic module diagnoses a fault in a component of the vehicle. In response to the diagnosis of the fault, the diagnostic module stores diagnostic data in a computer readable medium. The diagnostic data includes both a predetermined diagnostic trouble code associated with the fault diagnosed and the location of the vehicle when the fault was diagnosed.

In further features, a system includes: the fault diagnostic system and a data server. The data server is external to the vehicle and receives the diagnostic data including the diagnostic trouble code and the location of the vehicle. The data server compares the location of the vehicle with predetermined locations of vehicle service providers, respectively.

In still further features, based on the comparison, the data server updates the diagnostic data to include an indicator of whether the location of the vehicle is less than a predetermined distance from one or more of the predetermined locations.

In yet further features, a service tool downloads the diagnostic data from the vehicle, and the data server receives the diagnostic data from the service tool.

In further features, a communication module transmits the diagnostic data to the data server.

In still further features, when the location of the vehicle is less than a predetermined distance from one or more of the predetermined locations, the data server updates the diagnostic data to include a first indicator; and when the location of the vehicle is greater than the predetermined distance from all of the predetermined locations, the data server updates the diagnostic data to include a second indicator that is different than the first indicator.

In yet further features, a computing device that is external to the vehicle and the data server, transmits a request for diagnostic data to the data server based on user input to the computing device. In response to the request, the data server identifies first diagnostic data including the first indicator and identifies second diagnostic data including the second indicator.

In further features, in response to the request, the data server transmits only the second diagnostic data including the second indicator to the computing device.

In still further features, the computing device displays the second diagnostic data on a display.

A fault diagnostic method includes: determining a location of the vehicle; diagnosing a fault in a component of the vehicle; and, in response to the diagnosis of the fault, storing diagnostic data in a computer readable medium of the vehicle. The diagnostic data includes both a predetermined diagnostic trouble code associated with the fault diagnosed and the location of the vehicle when the fault was diagnosed.

In further features, the fault diagnostic method includes: using a data server that is external to the vehicle, comparing the location of the vehicle with predetermined locations of vehicle service providers, respectively.

In still further features, the fault diagnostic method includes: using the data server, updating the diagnostic data to include an indicator of whether the location of the vehicle is less than a predetermined distance from one or more of the predetermined locations.

In yet further features, the fault diagnostic method includes: using a service tool, downloading the diagnostic data from the vehicle; and, using the service tool, transmitting the diagnostic data to the data server. The service tool is separate from the vehicle and the data server.

In further features, the fault diagnostic method includes: using a communication module disposed within the vehicle, transmitting the diagnostic data to the data server.

In still further features, the fault diagnostic method includes: using the data server, when the location of the vehicle is less than a predetermined distance from one or more of the predetermined locations, updating the diagnostic data to include a first indicator; and, using the data server, when the location of the vehicle is greater than the predetermined distance from all of the predetermined locations, updating the diagnostic data to include a second indicator that is different than the first indicator.

In yet further features, the fault diagnostic method includes: receiving a request for diagnostic data from a computing device based on user input to the computing device; and, using the data server, in response to the request, identifying first diagnostic data including the first indicator and identifying second diagnostic data including the second indicator. The computing device is separate from the vehicle and the data server.

In further features, the fault diagnostic method includes: using the data server, transmitting only the second diagnostic data including the second indicator to the computing device.

In still further features, the fault diagnostic method includes: using the computing device, displaying the second diagnostic data on a display.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Diagnostic systems of a vehicle diagnose faults in various components of the vehicle. When a fault is diagnosed, a diagnostic trouble code (DTC) representative of the fault may be set and stored. The DTC may be transmitted to a vehicle manufacturer such as during vehicle servicing and/or wirelessly by the vehicle. Some activities conducted during servicing, however, may cause one or more faults to be diagnosed. As a result, quality and warranty analysis of DTCs may not reflect actual faults.

The present disclosure provides example systems and methods for filtering DTCs that may have been set at locations where vehicles are serviced, such as dealerships. More specifically, the location of the vehicle is stored with the associated DTC when a fault is diagnosed. Based on the location of authorized vehicle service providers, DTCs set during vehicle service can be identified.

Figure 1:
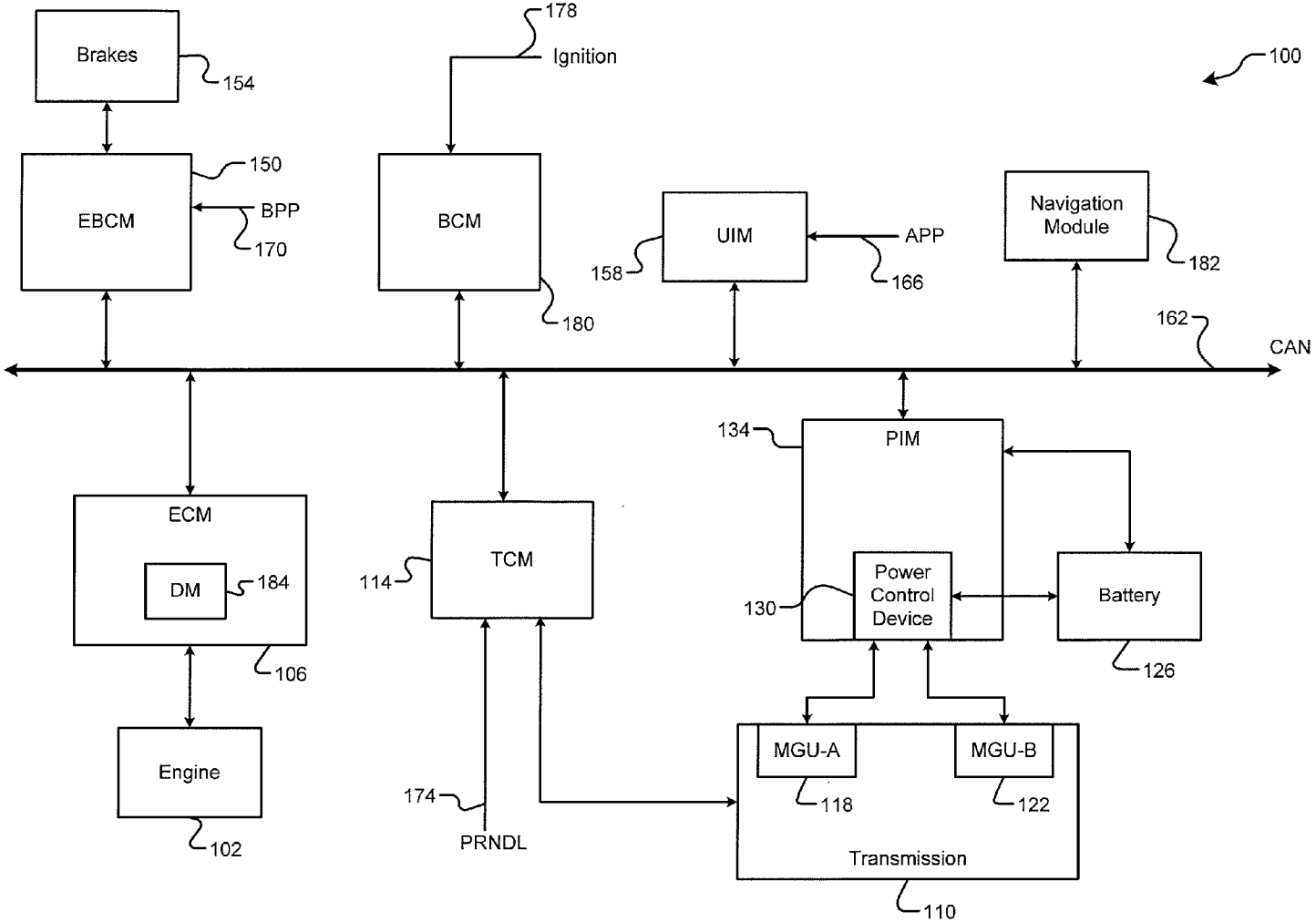
FIG. 1 is a functional block diagram of an example vehicle system according to the present disclosure.

Referring now to FIG. 1, a functional block diagram of an example vehicle system 100 is presented. While a vehicle system for a hybrid vehicle is shown and will be described, the present disclosure is also applicable to non-hybrid vehicles, electric vehicles, fuel cell vehicles, and other types of vehicles.

An engine 102 combusts an air/fuel mixture to generate drive torque. An engine control module (ECM) 106 controls the engine 102. For example, the ECM 106 may control actuation of engine actuators, such as a throttle valve, one or more spark plugs, one or more fuel injectors, valve actuators, camshaft phasers, an exhaust gas recirculation (EGR) valve, one or more boost devices, and other suitable engine actuators.

The engine 102 may output torque to a transmission 110. A transmission control module (TCM) 114 controls operation of the transmission 110. For example, the TCM 114 may control gear selection within the transmission 110 and one or more torque transfer devices (e.g., a torque converter, one or more clutches, etc.).

The vehicle system 100 may include one or more motors or motor generator units (MGUs). For example, a first MGU (MGU-A) 118 and a second MGU (MGU-B) 122 may be implemented within the transmission 110 as shown in the example of FIG. 1. An MGU can act as either a generator or as a motor at a given time. When acting as a generator, an MGU converts mechanical energy into electrical energy. The electrical energy can be, for example, used to charge a battery 126 via a power control device 130. When acting as a motor, an MGU generates torque that may be used, for example, to supplement or replace torque output by the engine 102. In various implementations, one power control device may be provided for each MGU.

A power inverter control module (PIM) 134 may control the MGU-A 118, the MGU-B 122, and the power control device 130. The PIM 134 may be referred to as a transmission power inverter module (TPIM) or a traction power inverter module (TPIM) in various implementations.

An electronic brake control module (EBCM) 150 may selectively control brakes 154 of the vehicle. A user interface module (UIM) 158 provides one or more driver inputs to a controller area network (CAN) 162. The CAN 162 may also be referred to as a car area network. For example, the CAN 162 may include one or more data buses. Various parameters read by a given control module may be made available to other control modules via the CAN 162.

The driver inputs may include, for example, an accelerator pedal position (APP) 166. A brake pedal position (BPP) 170 may be provided to the EBCM 150. A position 174 of a park, reverse, neutral, drive lever (PRNDL) may be provided to the TCM 114. The PRNDL position 174 may also be provided to the PIM 134 in various implementations. An ignition state 178 may be provided to a body control module (BCM) 180. For example, the ignition state 178 may be input by a driver via an ignition key, button, or switch. At a given time, the ignition state 178 may be one of off, accessory, run, or crank.

A diagnostic module (DM) 184 diagnoses whether various types of faults are present. One specific diagnostic trouble code (DTC) is associated with each type of fault. While the DM 184 is shown and will be discussed as being implemented within the ECM 106, the vehicle may include one or more other DMs. For example, the TCM 114, the EBCM 150, the BCM 180, the UIM 158, and/or other modules may each include a DM.

The vehicle system 100 may include a navigation module 182. The navigation module 182 may include a global position system (GPS) and determines a location of the vehicle. The navigation module 182 may, for example, display the location of the vehicle on a map. The navigation module 182 may also receive inputs and display various other information.

A vehicle may include one or more additional control modules that are not shown, such as a chassis control module, a battery pack control module, etc. A vehicle may omit one or more of the control modules shown and discussed.

Figure 2:
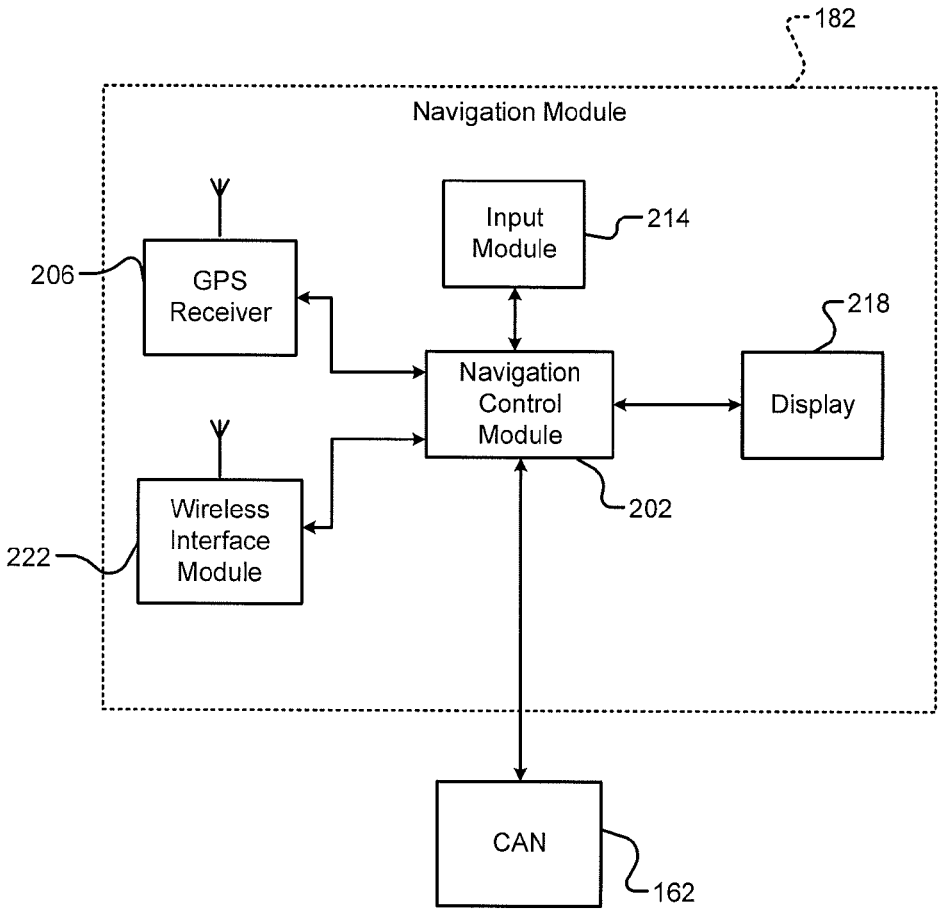
FIG. 2 is functional block diagram of an example navigation module according to the present disclosure.

Referring now to FIG. 2, a functional block diagram of an example implementation of the navigation module 182 is presented. The navigation module 182 includes a navigation control module 202 which communicates with other modules of the vehicle, such as the ECM 106, via the CAN 162. The navigation module 182 also includes a GPS receiver 206, an input module 214, a display 218, and a wireless interface module 222.

The navigation control module 202 displays information on the display 218 and receives user input via the input module 214. In various implementations, the display 218 may include a touch screen and may also serve as part of the input module 214. The input module 214 may include one or more other user input devices, such as buttons, switches, knobs, etc.

The navigation control module 202 may receive a location of the vehicle from the GPS receiver 206. The GPS receiver 206 monitors location of the vehicle and outputs the location to the navigation control module 202. For example, GPS receiver 206 may determine the vehicle location based on data provided by a satellite system. The vehicle location may be, for example, an address, a coordinate (e.g., longitude and latitude), and/or another suitable locational parameter. The navigation control module 202 may also obtain the vehicle location in other ways, such as from terrestrial wireless networks via the wireless interface module 222. The GPS receiver 206 may also monitor additional information, such as an altitude at which the vehicle is traveling and/or a travel direction of the vehicle.

The wireless interface module 222 receives and transmits information wirelessly. The wireless interface module 222 may communicate with, for example, satellite networks, terrestrial wireless networks, and/or other suitable types of wireless communication networks. The wireless interface module 222 may also transmit information received from modules via the CAN 162, such as the ECM 106. For example, the wireless interface module 222 may transmit information to a remote data server, as discussed further below.

Figure 3:
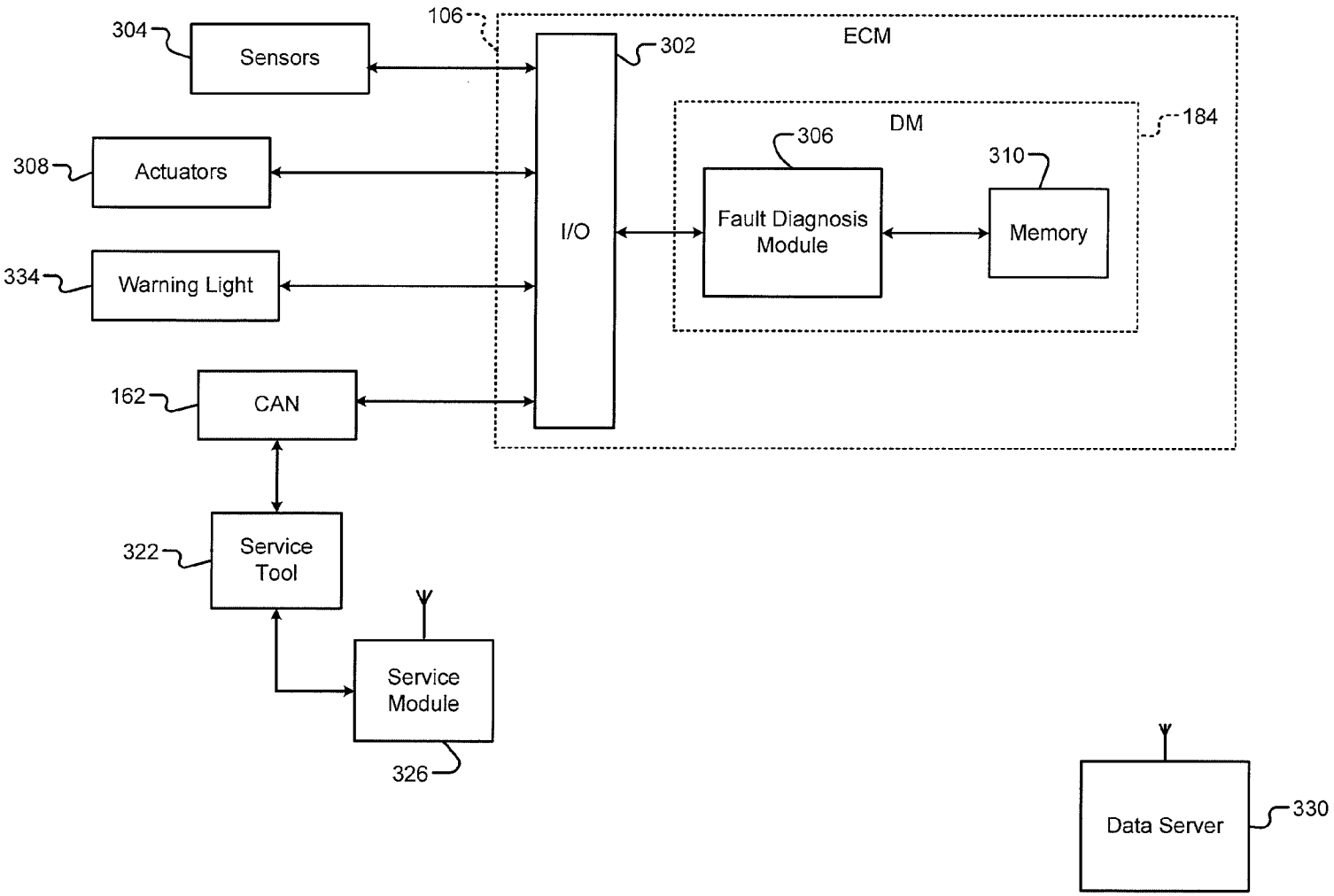
FIG. 3. is a functional block diagram of an example engine control module according to the present disclosure.

Referring now to FIG. 3, a functional block diagram of an example implementation of a portion of the ECM 106 is presented. The ECM 106 includes the DM 184 and an input/output (I/O) interface 302. The ECM 106 may communicate with components of the engine 102, such as sensors 304 of the engine 102 and engine actuators 308, via the I/O interface 302. The ECM 106 may also communicate with the CAN 162 via the I/O interlace 302.

The DM 184 may include a fault diagnosis module 306 and memory 310. The fault diagnosis module 306 may receive information from various sources, such as the sensors 304 and/or actuators 308 of the engine 102. The fault diagnosis module 306 may also receive information from other modules, such as the TCM 114, via the I/O interface 302. The fault diagnosis module 306 may diagnose a fault in, for example, one of the sensors 304, one of the actuator 308, and/or another module. The fault diagnosis module 306 may store DTCs that may be used to identify the particular fault diagnosed in the memory 310.

For example, the fault diagnosis module 306 may perform a communication diagnostic with another module, such as the TCM 114. The fault diagnosis module 306 may transmit a communication request to the TCM 114. If a satisfactory response from the TCM 114 is not received (e.g., within a predetermined period), the fault diagnosis module 306 may diagnosis a communication fault in the TCM 114. Such a fault may occur when the TCM 114 is disconnected from the CAN 162. The fault diagnosis module 306 stores a DTC representative of the TCM 114 having the communication fault in the memory 310.

Along with a DTC, the fault diagnosis module 306 may store additional information regarding the diagnosed fault. For example, the fault diagnosis module 306 may acquire the location of the vehicle when the fault is diagnosed. The fault diagnosis module 306 may acquire the location from, for example, the navigation module 182 via the CAN 162. The fault diagnosis module 306 may also store the altitude and the direction of travel (heading) of the vehicle when the fault is diagnosed. The vehicle location, the altitude, and/or the travel direction may be stored with the DTC in the memory 310 as diagnostic data for the diagnosed fault.

The fault diagnosis module 306 may indicate the occurrence of a fault in one or more ways. For example, the fault diagnosis module 306 may illuminate a warning light 334 and/or request the navigation module 182 to display a message on the display 218 when a fault is diagnosed. The fault diagnosis module 306 may also indicate the fault by storing the diagnostic data (including the DTC and the vehicle location) in the memory 310.

A service tool 322 is connectable and disconnectable to and from the CAN 162. The service tool 322 may be used to diagnose and repair faults in the vehicle. For example, the service tool 322 may retrieve diagnostic data stored in the memory 310 of the DM 184 so one or more faults diagnosed can be identified. The service tool 322 may also be used to modify or clear diagnostic data stored in the memory 310.

The service tool 322 may transfer diagnostic data retrieved from the DM 184 to a service module 326, such as a computer at a vehicle service provider. The service module 326 may transfer diagnostic data to a data server 330. The service module 326 may transfer diagnostic data via wireless communication or wired communication. In various implementations, the service tool 322 may transmit received diagnostic data directly to the data server 330 and/or the vehicle (e.g., the navigation module 182) may transmit diagnostic data directly to the data server 330.

The data server 330 may compile and store diagnostic data for various faults diagnosed from various vehicles. The diagnostic data stored by the data server 330 may be utilized, for example, by a vehicle manufacturer to identify the source of a fault and/or to prevent faults from occurring in the future. The data server 330 may also store additional information, such as locations of vehicle service providers.

Figure 4:
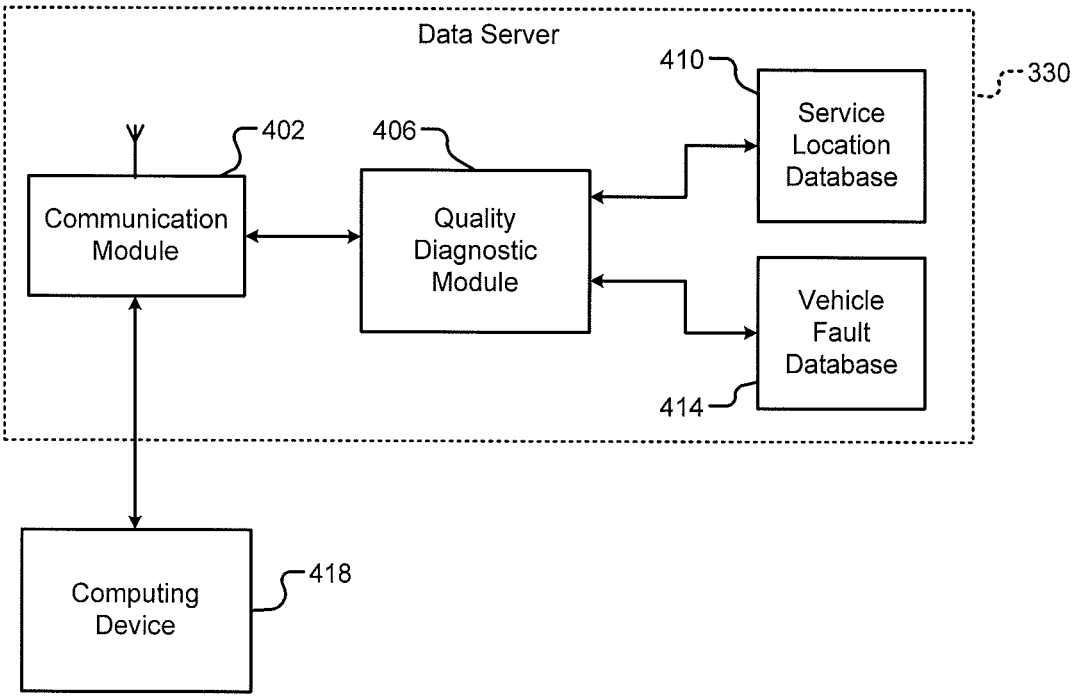
FIG. 4 is a functional block diagram of an example data server according to the present disclosure.

Referring now to FIG. 4, an example implementation of the data server 330 is presented. The data server 330 may include a communication module 402 and a quality diagnostic module 406. The quality diagnostic module 406 may communicate with a service location database 410 and a vehicle fault database 414. The service location database 410 stores locations of vehicle service providers. Vehicle service providers may include, for example, vehicle dealerships and other authorized vehicle servicers. The vehicle fault database 414 stores diagnostic data diagnosed by DMs of various vehicles and transmitted to the data server 330.

The quality diagnostic module 406 transmits and receives information via the communication module 402. The communication module 402 may transmit and receive information via wireless and/or wired communication networks. For example, the communication module 402 may receive information from vehicles and/or information from vehicle service providers. The quality diagnostic module 406 stores received diagnostic data for vehicles in the vehicle fault database 414.

The data server 330 may also receive information regarding the locations of vehicle service providers. The locations of the vehicle service providers may be addresses, coordinates (e.g., longitude and latitude), and/or another suitable locational parameters. The quality diagnostic module 406 stores the locations of the vehicle service providers in the service location database 410 which may serve as a directory of vehicle service providers.

The quality diagnostic module 406 may filter diagnostic data stored in the vehicle fault database 414 based on the information stored in the service location database 410. The quality diagnostic module 406 may filter DTCs that are set at or in proximity of a vehicle service provider.

The quality diagnostic module 406 may, for example, receive a piece of diagnostic data from a vehicle or a vehicle service provider. As described above, the piece of diagnostic data includes both the DTC corresponding to the fault diagnosed and the location of the vehicle when the fault was diagnosed. The quality diagnostic module 406 may compare the vehicle location with the locations stored in the service location database 410. For example, the quality diagnostic module 406 may determine whether the vehicle location is within a predetermined distance from the location of a vehicle service provider. The predetermined distance may be a roadway distance, a straight line distance from the vehicle to the vehicle service provider, or another suitable measurement. The predetermined distance may be, for example, a quarter of a mile or another suitable distance. The predetermined distance may be adjustable, for example, by a user.

The quality diagnostic module 406 may filter the piece of diagnostic data when the vehicle location is within the predetermined distance of a vehicle service provider. For example, when the vehicle location of the piece of diagnostic data is within the predetermined distance of the location of a vehicle service provider, the quality diagnostic module 406 may update the piece of diagnostic data to indicate that the DTC was set within the predetermined distance of a vehicle service provider. Conversely, when the vehicle location of the piece of diagnostic data is not within the predetermined distance of any vehicle service provider, the quality diagnostic module 406 may update the piece of diagnostic data to indicate that the DTC was not set within the predetermined distance of a vehicle service provider. The quality diagnostic module 406 may save the diagnostic data where the DTCs were set within the predetermined distance of a vehicle service provider in a different portion of the vehicle fault database 414 or in another database than diagnostic data with DTCs not set within the predetermined distance of a vehicle service provider.

Additionally, the quality diagnostic module 406 may filter the diagnostic data stored in the vehicle fault database 414 based on the altitude of the vehicle at the time the faults were detected. For example, when the altitude of a piece of diagnostic data is greater than a predetermined altitude, the quality diagnostic module 406 may update the piece of diagnostic data to indicate that the fault was diagnosed when the altitude was greater than the predetermined altitude. Conversely, when the altitude of the piece of diagnostic data is less than or equal to the predetermined altitude, the quality diagnostic module 406 may update the piece of diagnostic data to indicate that fault was diagnosed when the altitude was less than or equal to the predetermined altitude.

Additionally, the quality diagnostic module 406 may filter the diagnostic data stored in the vehicle fault database 414 based on the heading of the vehicle at the time the faults were detected. For example, based on the vehicle location, the altitude, and/or the travel direction of the piece of diagnostic data, the quality diagnostic module 406 may determine whether the vehicle was traveling uphill or downhill when the fault was diagnosed. The quality diagnostic module 406 may update the piece of diagnostic data to include whether the vehicle was heading uphill or downhill when the fault was diagnosed.

A computing device 418 may access information stored in the data server 330 via the communication module 402. For example, the computing device 418 may communicate with the quality diagnostic module 406 via the communication module 402. The computing device 418 may communicate with the data server 330 via wireless and/or wired communication.

The computing device 418 may perform a search of diagnostic data stored in the vehicle fault database 414. For example, the computing device 418 may request diagnostic data that meets specified search parameters. Various search parameters may be available and implemented for acquiring specific diagnostic data. For example, search parameters may include diagnostic data received within a predetermined period, diagnostic data having a specific DTC, diagnostic data associated with a particular vehicle system, diagnostic data for faults diagnosed within the predetermined distance of a vehicle service provider, diagnostic data for faults not diagnosed within the predetermined distance of a vehicle service provider, diagnostic data for faults diagnosed at greater than the predetermined altitude, diagnostic data for faults diagnosed at less than the predetermined altitude, diagnostic data for faults diagnosed when the vehicle is traveling uphill, diagnostic data for faults diagnosed when the vehicle is traveling downhill, and/or other search parameters.

The quality diagnostic module 406 may acquire and transmit diagnostic data meeting the specified search parameters to the computing device 418. The computing device 418 may, for example, display the received diagnostic data on a display.

Figure 5:
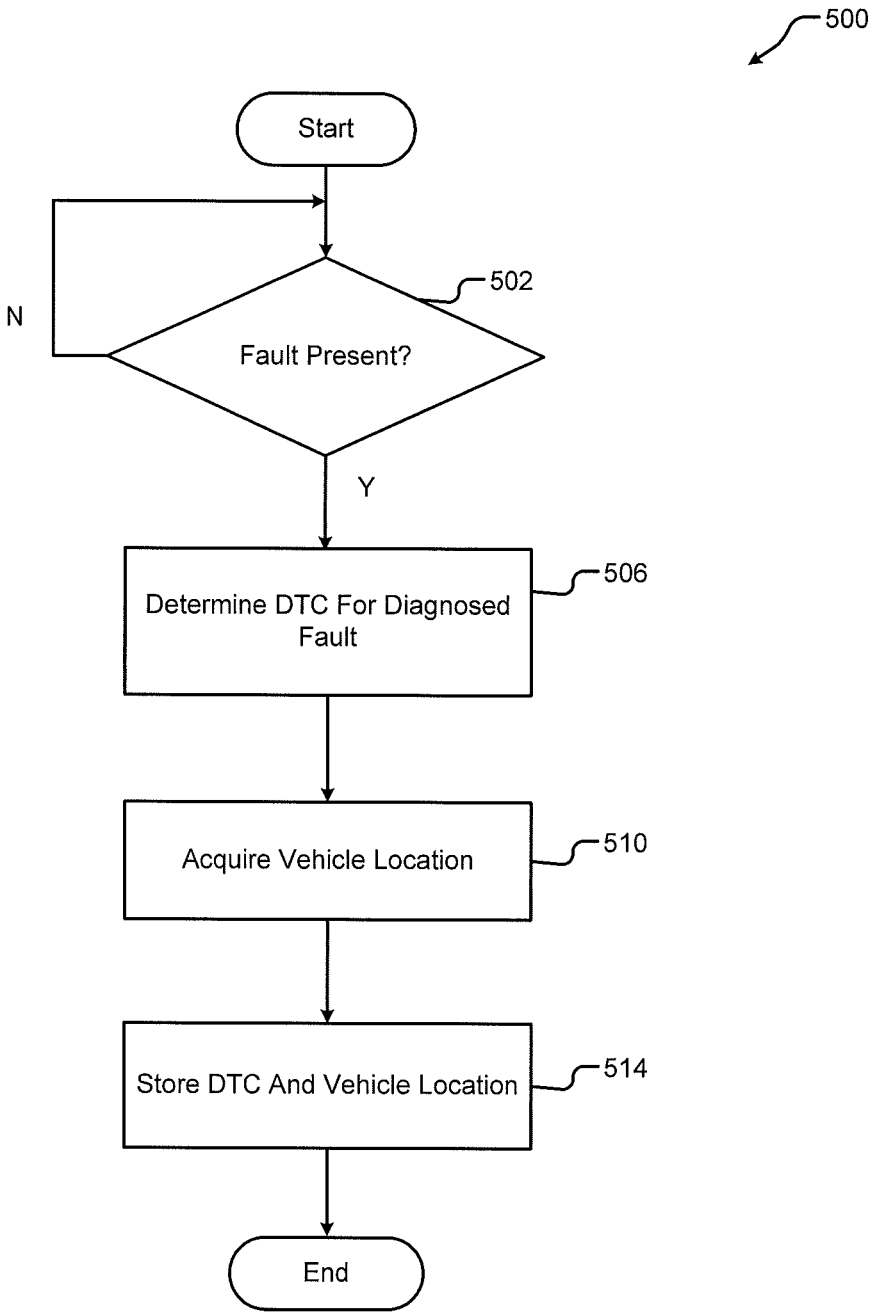
FIG. 5 illustrates an example method of storing diagnostic data of a diagnosed fault using a diagnostic module according to the present disclosure.

Referring now to FIG. 5, a flowchart of an example method 500 of storing a DTC of a diagnosed fault and a vehicle location as diagnostic data is presented. Control may begin with 502 where the DM 184 determines whether a fault is present. If 502 is true, control continues with 506. If 502 is false, control remains at 502.

At 506, the DM 184 determines a DTC for the fault diagnosed. At 510, the DM 184 acquires the vehicle location. For example, the DM 184 may acquire the vehicle location from the navigation module 182 via the CAN 162. At 514, the DM 184 stores the DTC and the vehicle location in the memory 310 as diagnostic data.

Figure 6:
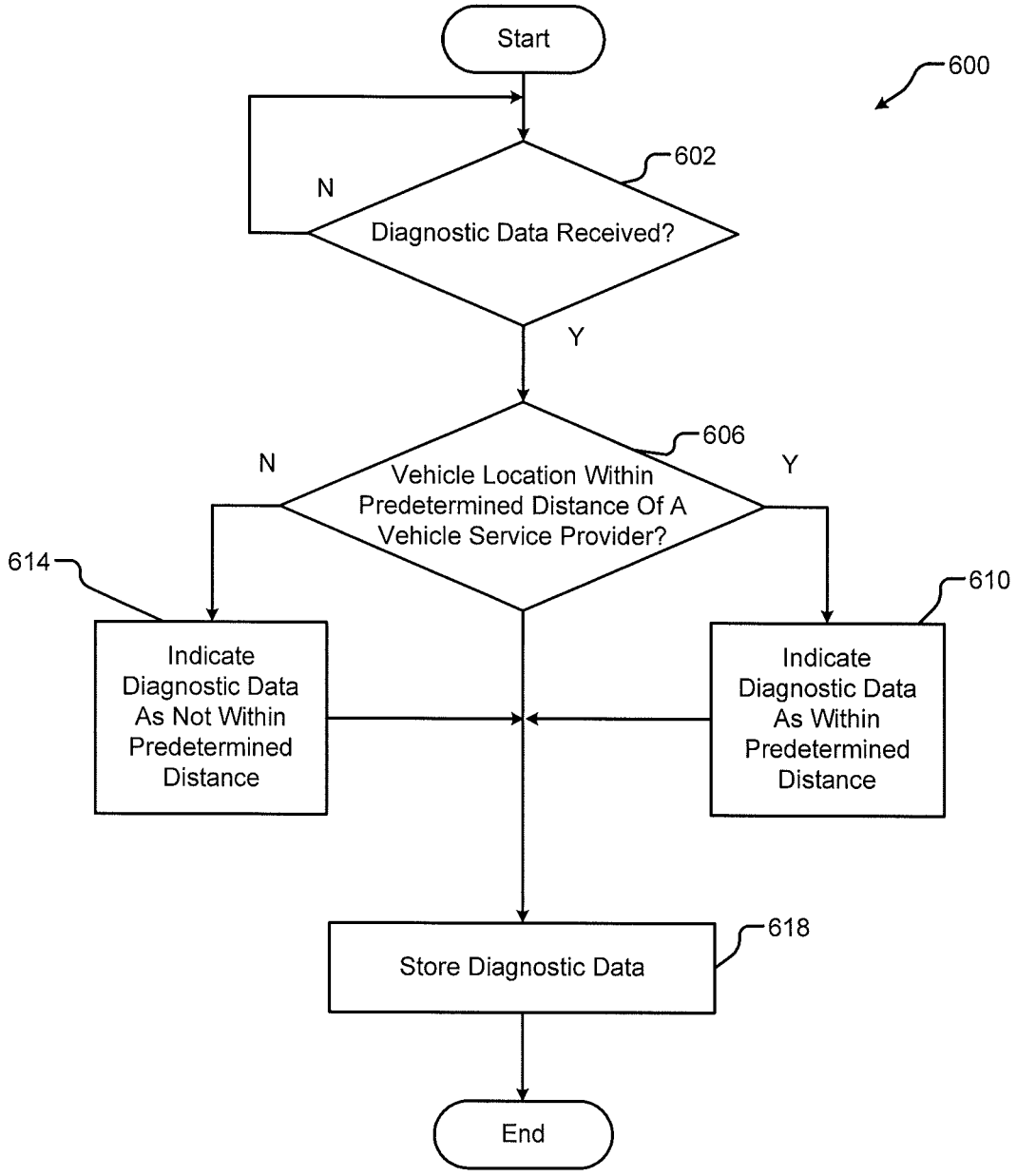
FIG. 6 illustrates an example method of filtering diagnostic data using a data server according to the present disclosure.

Referring now to FIG. 6 a flowchart of an example method 600 of compiling diagnostic data received by the data server 330 is presented. Control may begin with 602 where the data server 330 determines whether a piece of diagnostic data (including a DTC and the vehicle location where the associated fault was diagnosed) has been received. If 602 is true, control continues with 606. If 602 is false, control remains at 602.

At 606, the data server 330 determines whether the vehicle location provided in the diagnostic data is within the predetermined distance of a vehicle service provider. The quality diagnostic module 406 compares the vehicle location with locations of vehicle service providers stored in the service location database 410. If 606 is true, control proceeds with 610. If 606 is false, control proceeds with 614.

At 610, the data server 330 updates the diagnostic data to indicate that the DTC was set within the predetermined distance of a vehicle service provider, and control proceeds with 618. At 614, the data server 330 updates the diagnostic data to indicate that the DTC was not set within the predetermined distance of any of the vehicle service providers, and control proceeds with 618. At 618, the data server 330 stores the diagnostic data (including the indicator of whether the DTC was set within the predetermined distance of a vehicle service provider).

Figure 7:
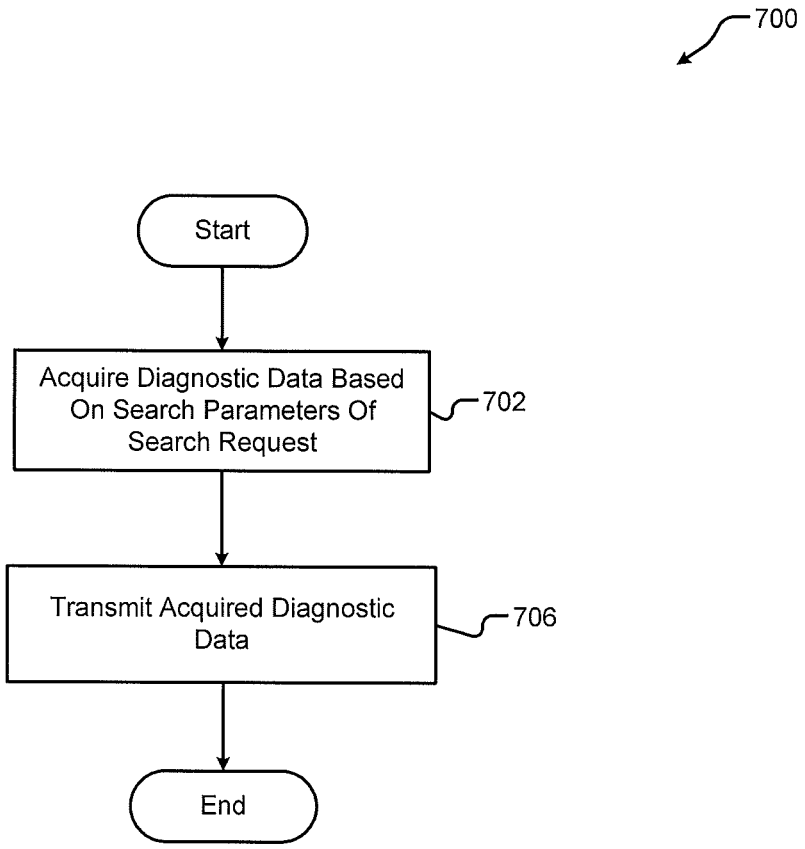
FIG. 7 illustrates an example method of transmitting requested diagnostic data using the data server according to the present disclosure.

Referring now to FIG. 7, a flowchart of an example method 700 of acquiring diagnostic data based on a search request is presented. The computing device 418 may transmit the search request to the data server 330 based on user input to the computing device 418. The search request may include specific search parameters. For example, the search request may request that diagnostic data indicating that their DTCs were set within the predetermined distance of a vehicle service provider be filtered out and that diagnostic data indicating that their DTCs were not set within the predetermined distance of any of the vehicle service providers be provided.

Control may begin with 702 where the data server 330 acquires diagnostic data based on search parameters of the search request. For example, the data server 330 filters diagnostic data stored in the vehicle fault database based on whether the diagnostic data indicates that the DTCs were set within the predetermined distance of a vehicle service provider. At 706, the data server 330 transmits the diagnostic data acquired to the computing device 418. For example, the data server 330 may only transmit diagnostic data indicating that their DTCs were not set within the predetermined distance of any of the vehicle service providers to the computing device 418. This may present a more relevant set of diagnostic data (i.e., only diagnostic data indicating that their DTCs were not set within the predetermined distance of any of the vehicle service providers) to a user of the computing device 418.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a global positioning system (GPS) receiver that determines a location of a vehicle;

a diagnostic module that diagnosis a fault in a component of the vehicle and that, in response to the diagnosis of the fault, stores diagnostic data in a computer readable medium, the diagnostic data including both a predetermined diagnostic trouble code associated with the fault diagnosed and the location of the vehicle when the fault was diagnosed;

a data server that (i) is external to the vehicle, that (ii) receives the diagnostic data including the diagnostic trouble code and the location of the vehicle, that (iii) when the location of the vehicle is less than a predetermined distance from one or more of predetermined locations of vehicle service providers, updates the diagnostic data to include a first indicator, and that (iv) when the location of the vehicle is greater than the predetermined distance from all of the predetermined locations of the vehicle service providers, the data server updates the diagnostic data to include a second indicator that is different than the first indicator; and a computing device that is external to the vehicle and the data server and that, based on user input to the computing device, transmits a request for diagnostic data to the data server, wherein, in response to the request, the data server does not transmit first diagnostic data including the first indicator to the computing device and the data server transmits second diagnostic data including the second indicator to the computing device.

2. The system of claim 1 further comprising:

a service tool that downloads the diagnostic data from the vehicle, wherein the data server receives the diagnostic data from the service tool.

3. The system of claim 1 wherein the vehicle further includes:

a communication module that transmits the diagnostic data to the data server.

4. The system of claim 1 wherein the computing device displays the second diagnostic data on a display.

5. A fault diagnostic method comprising:

determining a location of a vehicle;

diagnosing a fault in a component of the vehicle;

in response to the diagnosis of the fault, storing diagnostic data in a computer readable medium of the vehicle, wherein the diagnostic data includes both a predetermined diagnostic trouble code associated with the fault diagnosed and the location of the vehicle when the fault was diagnosed; and using a data server that is external to the vehicle:

when the location of the vehicle is less than a predetermined distance from one or more of predetermined locations of vehicle service providers, respectively, updating the diagnostic data to include a first indicator;

when the location of the vehicle is greater than the predetermined distance from all of the predetermined locations of the vehicle service providers, updating the diagnostic data to include a second indicator that is different than the first indicator;

receiving a request for diagnostic data from a computing device generated based on user input to the computing device, wherein the computing device is external to the vehicle and the data server; and, in response to the request:

not transmitting first diagnostic data including the first indicator to the computing device; and transmitting second diagnostic data including the second indicator to the computing device.

6. The fault diagnostic method of claim 5 further comprising:

using a service tool, downloading the diagnostic data from the vehicle, wherein the service tool is separate from the vehicle and the data server; and, using the service tool, transmitting the diagnostic data to the data server.

7. The fault diagnostic method of claim 5 further comprising:

using a communication module disposed within the vehicle, transmitting the diagnostic data to the data server.

8. The fault diagnostic method of claim 5 further comprising:

using the computing device, displaying the second diagnostic data on a display.

* * * * *